United States Patent [19]

Casale et al.

[11] Patent Number: 4,902,070

[45] Date of Patent: Feb. 20, 1990

[54] FOLDABLE AUTOMOBILE CONVERTIBLE SEAT

[75] Inventors: Rudy J. Casale; Neil Messina, both of Brooklyn, N.Y.

[73] Assignee: Child Riding Incorporated, Garden City, N.Y.

[21] Appl. No.: 244,430

[22] Filed: Sep. 16, 1988

[51] Int. Cl.[4] ..... A47C 15/00

[52] U.S. Cl. ..... 297/238; 297/331; 297/379; 296/68.1

[58] Field of Search ..... 296/68.1; 297/238, 331, 297/378, 379

[56] References Cited

U.S. PATENT DOCUMENTS

| | | | |
|---|---|---|---|
| 2,584,481 | 2/1952 | Mast et al. | 297/238 X |
| 4,105,245 | 8/1978 | Simons et al. | 297/379 X |
| 4,655,503 | 4/1987 | Kamijo et al. | 297/238 |
| 4,664,443 | 5/1987 | Casale | 297/238 |
| 4,684,175 | 8/1987 | Trutter | 297/379 |
| 4,722,568 | 2/1988 | Irvin | 297/238 |
| 4,756,573 | 7/1988 | Simin et al. | 297/238 X |
| 4,789,205 | 12/1988 | Pipon et al. | 297/379 X |

FOREIGN PATENT DOCUMENTS

| | | | |
|---|---|---|---|
| 2411104 | 8/1979 | France | 297/379 |

*Primary Examiner*—Margaret A. Focarino
*Assistant Examiner*—Andrew C. Pike
*Attorney, Agent, or Firm*—Lilling & Greenspan

[57] ABSTRACT

An adult to infant convertible seat is described for automobiles and other moving vehicles which have a storage compartment behind the convertible seat. The infant seat is retractable into the storage compartment and extendible into the infant seat use position. The infant or child seat is provided with an upper back rest portion and lower seat portion which are selectively connected and locked to each other to permit unfolding of the seat when a child seat is to be used in a folded condition which substantially reduces the clearance radius of the seat thereby permitting the movement of the child seat in the folded condition into smaller storage compartments and areas of smaller dimensions.

11 Claims, 3 Drawing Sheets

FOLDABLE AUTOMOBILE CONVERTIBLE SEAT

BACKGROUND OF THE INVENTION

1. Field of the Invention

This invention generally relates to automobile seats, and more specifically to an adult to infant foldable seat for automobiles and other moving vehicles which have trunks or storage compartments behind the convertible seat.

2. Description of the Prior Art

An automobile adult seat does not provide adequate safety for children, particularly very young infants. Numerous devices have been proposed for enhancing the safety for children while driving in automobiles. While seat belts have provided some measure of safety for older children, separate smaller seats have generally been used for young infants since these tend to restrain the child from movement in almost every direction.

In most instances, these infant seats have been separate seats which can be installed on an adult automobile seat and secured in some fashion thereto by means of, for example, the adult seat belts. This type of infant seat suffers from two primary disadvantages. Firstly, if the infant seat is improperly fastened to the adult seat, the seat can move relative to or separate from the adult seat thereby failing to provide the expected restraint on the child. Secondly, the adult seat to which the infant seat is attached is clearly not usable by the adult until the infant seat is removed. Therefore, whenever an adult needs to use the seat, the infant seat must be removed and stored until the next time it is needed for the infant. When the trunk of the vehicle has sufficient space therein, the normally bulky infant seats can be stored therein although they obviously occupy a significant portion of the trunk space. In addition to being a time consuming and inconvenient procedure, the infant seat must again be carefully secured to the adult seat each time that the infant needs to use same.

As a result of the disadvantages discussed above in connection with movable or portable infant seats, there has also been proposed infant seats which are integrally built into an adult automobile seat such that the adult seat can be converted into an infant seat typically by moving one or more members of the adult seat and uncovering and unfolding a normally collapsed infant seat into its desired position.

The infant seats of this last mentioned type generally provide a child restraint which is in the nature of a bar or padded portion which is placed in front of the child while it is within the infant seat. The restraint, however, serves no other function, for example, when the infant seat is converted into an adult seat. These infant seats, therefore, have tended to be complex in construction and expensive to manufacture, and have not always provided the measure of safety or strength that the child restraint is intended to provide.

I have disclosed an automobile convertible seat in my earlier issued U.S. Pat. No. 4,664,443 issued on May 12, 1987, wherein an automobile adult seat converts to a child seat by pivotally mounting the child seat about fixed pivot points between an extended position wherein the child seat is usable by the child to a retracted position wherein the child seat is pivotally moved into the trunk or storage compartment behind the adult seat thereby converting the infant seat into an adult seat. However, my prior automobile convertible seat was disclosed as a single rigid unit which required significant clearance to allow the seat to be pivoted about the lower pivots into the trunk or storage compartment. This could be a problem in certain compact automobiles which have smaller trunk compartments or in certain older vehicles which have generally small clearances between the rear deck or platform beneath the rear window and the wheelwell of the automobile chassis. In the aforementioned situations, it is not practical or possible to install larger infant seats of the type disclosed in my previous patent.

SUMMARY OF THE INVENTION

In order to overcome the disadvantages inherent in the prior art convertible infant seat constructions, the seat in accordance with the present invention is for an adult to infant convertible seat for automobiles and for other moving vehicles having a storage compartment behind the convertible seat. The convertible seat includes a back rest section and a seat section of the adult seat. Said back rest section includes a generally fixed portion which remains stationary at all times and a movable portion which is proximate to the trunk or storage compartment behind said back rest section. A child seat is provided which is pivotally mounted about fixed pivot means for movements between retracted and extended positions in relation to the storage compartment. Said child seat includes an upper back rest portion and a lower seat portion which are selectively connected and locked to each other in one of folded and unfolded conditions to move together in the folded condition as a single unit between extended and retracted positions. Said child seat is substantially retracted within said storage compartment when the seat is to be used by a adult to position said movable back rest portion generally proximate to said fixed back rest portion, and said child seat being substantially extended exteriorily of said storage compartment for receiving a child and to position said movable back rest portion generally proximate to said seat section. Restraining means are provided for restraining a child placed in said child seat in the extended position of said child seat. An important feature of the preset invention is the provision of movable pivot means for pivotally connecting said back rest and seat portions of said child seat for movements between said folded and unfolded conditions. Locking means are provided for locking said back rest and seat portions to each other in each of said folded and unfolded conditions, said child seat in said folded condition having a clearance radius about said fixed pivot means smaller than in said unfolded condition, whereby retraction of said child seat in said folded condition into smaller storage compartments and areas of smaller dimensions is facilitated or made possible.

In accordance with the disclosed construction, said clearance radius of said child seat in said folded condition about said movable pivot means is approximately one-half the clearance of said child seat in said unfolded condition when said child seat is pivoted about said fixed pivot means from said extended to said retracted positions.

BRIEF DESCRIPTION OF THE DRAWINGS

The foregoing and other features of the present invention will be more readily apparent from the following detailed description and drawings of an illustrative embodiment of the invention in which.

DESCRIPTION OF THE PREFERRED EMBODIMENTS

Figure 1:
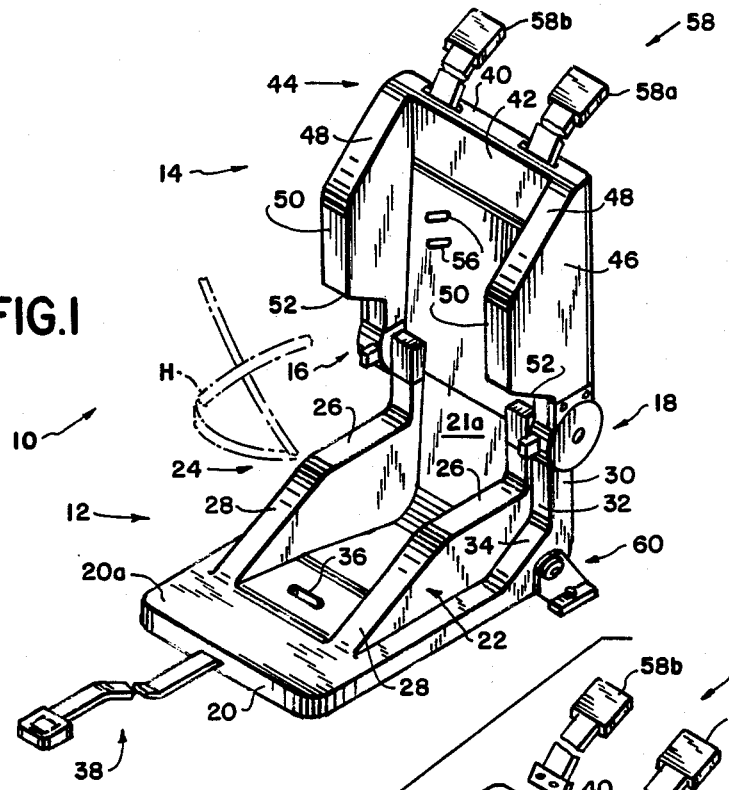
FIG. 1 is a perspective view, partially exploded, showing a convertible child seat in accordance with the present invention, shown in the unfolded condition and extended position and ready to receive a child to be restrained in an automobile or moving vehicle.
Figure 2:
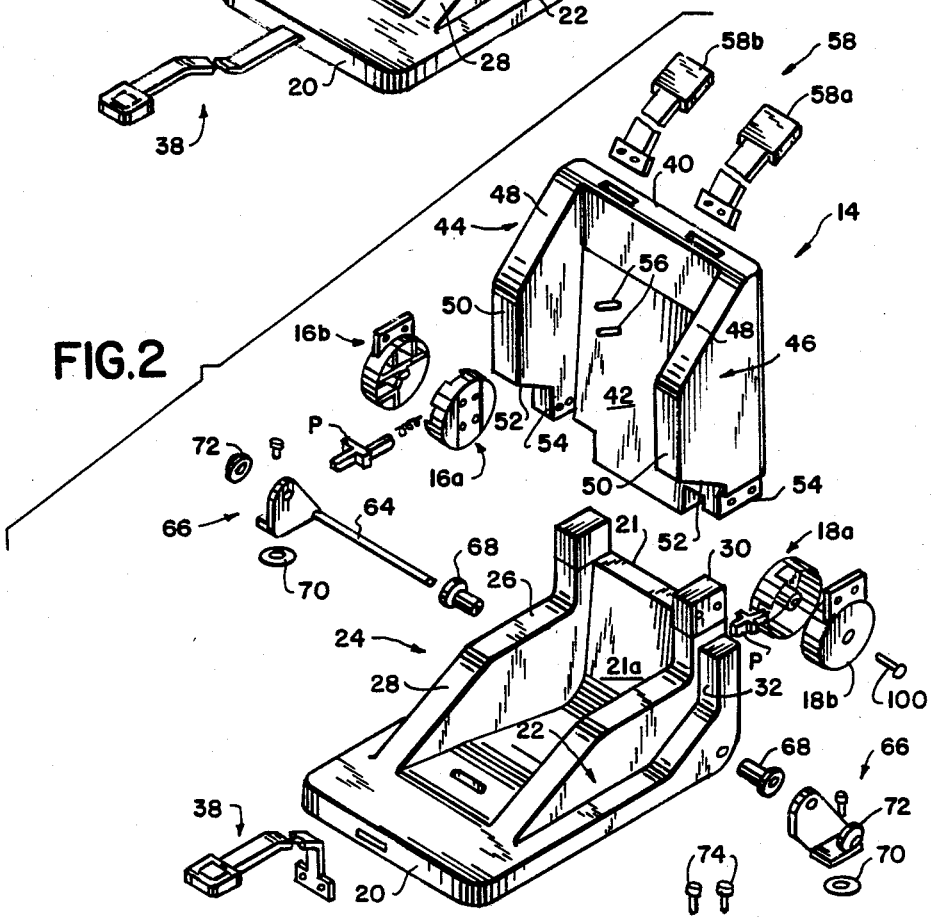
FIG. 2 is an exploded view of the seat shown in FIG. 1, showing the various elements or components of the seat and the manner in which such components are assembled.

Referring now specifically to the drawings, in which identical or similar parts are designated by the same reference numerals throughout, and first referring to FIGS. 1 and 2, the child or infant seat is generally designated by the reference numeral 10. It will be understood, however, that the environment in which the seat is used is disclosed in my earlier U.S. Pat. No. 4,664,443, and the details of the adult portions of the seat have been omitted herein for the sake of clarity and to avoid duplication. However, it will be appreciated that the infant seat 10 herein can be incorporated or integrated into any adult seat in back of which there is provided a trunk or storage compartment. Additionally, while the seat in my previous patent is shown as being incorporated in the center of each of the adult seats, it will also be appreciated by those skilled in the art that the infant seat described herein and in my earlier disclosure can be located or positioned anywhere along the adult seat, such as in the center where an arm rest would normally be placed, so long as there is a trunk or storage compartment in back of that portion of the adult seat.

The infant seat 10 includes a seat lower body or housing which defines a lower seat portion 12 and a seat upper body or housing which defines an upper back rest portion 14. The child seat lower seat and upper back rest portions 12, 14 can be made from any suitable materials commonly used for infant seats, such as high impact resistant plastics.

An important feature of the present invention is that the lower seat portion 12 and the upper back rest portion 14 are pivotally connected to each other about movable pivot points including right pivot locking assembly 16 and left pivot locking assembly 18, which will be more fully described below. Referring to FIG. 2, the right and left pivot locking assemblies 16, 18 are mirror-image constructions of each other and substantially comprise lower pivot lock member 16*a*, 18*a*, upper pivot, lock members 16*b*, 18*b* and push release buttons P.

The lower seat portion 12 includes a generally flat portion 20 which defines a seat surface 20*a* for the infant. Extending upwardly from the flat portion 20 are a flat portion 21 defining a lower back rest surface 21*a* and left and right arm rests 22, 24 as shown each having generally horizontal edges or surfaces 26, in the position shown, and downwardly sloped edges or surfaces 28.

The arm rests 22, 24 are inwardly recessed from the side edges of the flat portion 20 to form an upwardly directed lower mounting extensions 30, vertical surfaces or edges 32, downwardly inclined sloped edges or surfaces 34 which extends to the seat surface 20*a*. In the embodiment being described, the surfaces 34 are advantageously inclined at 45 degrees in relation to the seat surface 20*a*.

Formed in the flat portion 20, substantially midway between the arm rests 22, 24, is a slot 36 suitable for receiving a conventional belt harness H. A center belt lock assembly 38 is connected to the flat portion 20 for reasons to be more fully desired below.

The upper back rest portion 14 includes a flat portion 40 which forms an upper back rest surface 42 which is generally co-planar with the lower back rest surface 21*a* in the unfolded condition of the child seat 10 as shown in FIG. 1. Formed to each side of the upper back rest surface 42 is a right head rest 44 and left head rest 46. Each head rest includes a generally downwardly sloped or inclined edge or surface 48, generally vertical edge or surface 50 and downwardly sloped edge or surface 52. In the presently preferred embodiment, the surfaces 48 and 52 are inclined at substantially 45 degrees as shown.

The flat portion 40 is formed with a series of slots 56 suitable for receiving the conventional shoulder harness H. An upper belt lock assembly 58, including two straps 58*a* and 58*b*, is connected to the flat portion 40 for reasons to be more fully described below.

Figure 10:
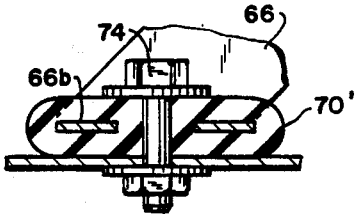
FIG. 10 is similar to FIG. 9 but showing an alternate construction of the shock-absorbing element.
Figure 3:
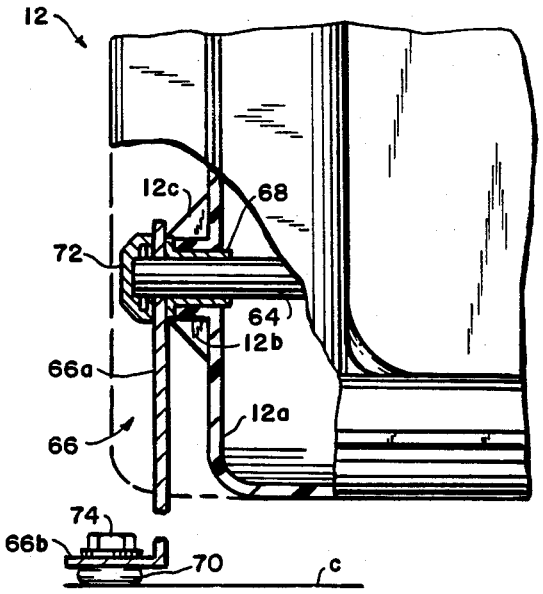
FIG. 3 is an enlarged front elevational view of the lower body or housing of the seat shown in FIG. 1, partially broken away, to show the details of mounting of the lower seat portion on the fixed pivots and showing one method of shock mounting of the seat on the automobile or moving vehicle chassis.

As will be more fully described in connection with FIGS. 3, 9 and 10, a mounting bracket and shock absorbing assembly 60 is provided for pivotally rotating the entire child seat 10 about fixed pivots between extended and retracted positions as disclosed in my previous U.S. Pat. No. 4,664,443. The mounting bracket and shock absorbing assembly 60 is shown in FIG. 2 to include a bore or channel 62 formed in the lower seat portion 12 in the region where the flat portions 20 and 21 meet or join, and a steel pivot axle 64 is dimensioned to be received within the bore or channel 62 and extends beyond each side of the lower seat position 12. Referring to FIGS. 2 and 3, each free end of the steel pivot axle 64 extends beyond the lower seat portion 12 to engage a bracket upright portion 66a of a mounting bracket 66.

Figure 9:
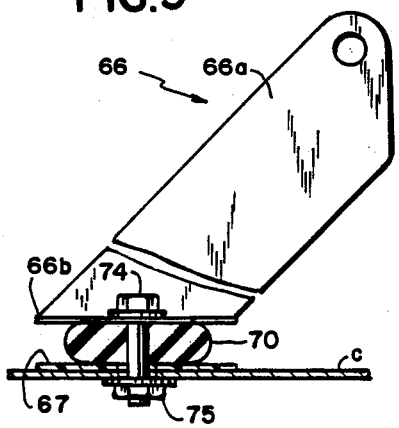
FIG. 9 is an enlarged side elevational view of the mounting bracket shown in FIG. 3, showing the mounting details thereof and the shock-absorbing bead.

Referring particularly to FIG. 9, in order to provide for absorbency of shocks transmitted from the automobile or vehicle chassis to the child seat, there is advantageously provided between the bracket portion 66b and a nylon washer 67 which abuts against the body wheel well or vehicle chassis "C" a rubber washer or annular bead 70 which provides resilient support of the lower seat portion 12. Once assembled, the aforementioned components are locked in place by lock nut 72, mounting shoulder bolt 74 and lock nut 75. Referring to FIG. 3, the side wall 12a of the lower seat portion 12 is advantageously provided with a tubular extension 12b which receives a Nylon washer 68. In order to rigidify the structure and strengthen the side wall 12a and the tubular extension 12b at the places of maximum stress, there are advantageously provided reinforcing ribs or gussets 12c as shown. The steel mounting brackets 66, are shown to have L-shaped cross sections, so that after the upright portions 66a are pivotally connected to the lower seat portion as shown, the lower mounting portion 66b of the bracket can be shock-mounted on the chassis "C" of the automobile or vehicle by means of any suitable mounting bolts 74, as suggested above.

While rubber washers 70 have been shown for the purpose of absorbing or minimizing shock transfers to the infant seat, it will be appreciated that numerous other approaches may be used to provide the same or similar function. Thus, while a shock absorbing mechanism should be provided, the specific construction or approach used is not critical. Thus, referring to FIG. 10, the lower mounting portion 66b of the bracket is shown encapsulated by high density rubber, which may be vulcanized to the bracket, to provide a different degree of shock absorbency or resiliency of support.

As previously suggested, an important feature of the present invention is the provision of the pivot locking assemblies 16, 18 which affectively permit the creation of a "rigid" child seat when in use while permitting the reduction in overall size of the infant seat when not in use in order to conserve space and reduce to the maximum extent the clearance required for storage of the child seat. Since both pivot locking assemblies are similar, only one will be described in detail.

Figure 4:
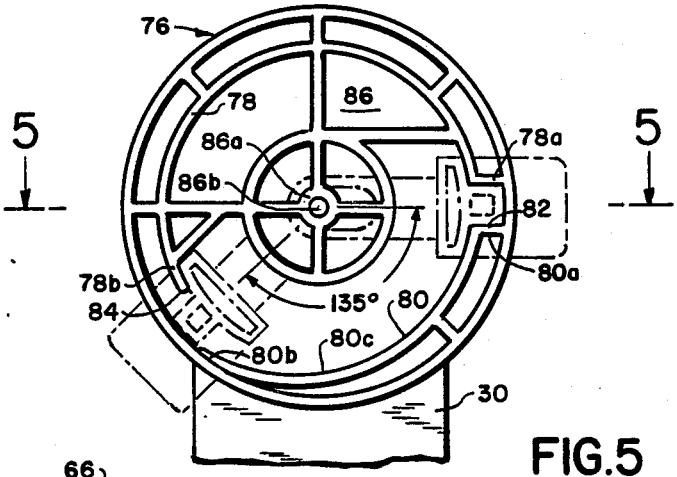
FIG. 4 is a side elevational view of the lower pivot lock member connected to the lower seat portion, and showing in phantom outline the pressure release button in both the unfolded and folded conditions of the seat.
Figure 5:
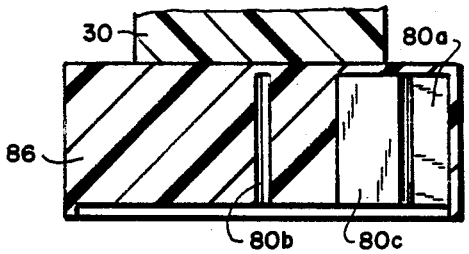
FIG. 5 is a cross section of the lower pivot lock member shown in FIG. 4, taken along line 5—5.

Referring to FIGS. 4 and 5, the lower pivot lock member 16a is in the nature of a circular outer housing 76. The housing 76 is open on one side thereof, as viewed in FIG. 4, and closed at the other axial side thereof. The housing 76 is mounted in any suitable manner on the lower mounting extensions 30 of the lower seat portion 12. In the embodiment shown in FIG. 2, the housings 76 are attached by means of screws or other fasteners to the lower mounting extensions 30. With the embodiment shown in FIG. 4, the housing is molded to the mounting extensions 30. The specific mode of attachment is not critical as long as the circular outer housings 76 are rigidly connected to the lower seat portion 12.

The housing 76 is in the form of a cylindrical outer shell or wall which has a circular cross section. Mounted therein is a circular rib or wall 78 which is shown to extend approximately 225 degrees in relation to the center or the axis of the housing 76. The circular rib 78 is concentric with the housing 76 and is provided at one end with an end portion 78a which bridges the gap or space between the walls or ribs 76 and 78 and extends in a radial direction as shown. The other free end 78b of the circular rib 78 is not provided with such a radial projection. Extending the remaining approximately 135 degrees within the inner housing 76 is a cam slide 80 which whose radial distance increases from one free end 80a to the other free end 80b. The end 80a is similar to the end 78a and also includes a radial bridging projection, the projections 78a and 80a being radially aligned to form a hole or opening 82 as shown. The ends 78b and 80b similarly define a hole or opening 84 although clearly the cam slide end 80b is radially outwardly spaced in relation to the rib end 78b.

Additional reinforcing ribs 86 are provided to reinforce the housing 76, the circular rib 78 and the cam slide 80, and to define a central hub or boss 86a which is provided with a center pivot hole 86b.

Figures 6, 7, 8, 11:
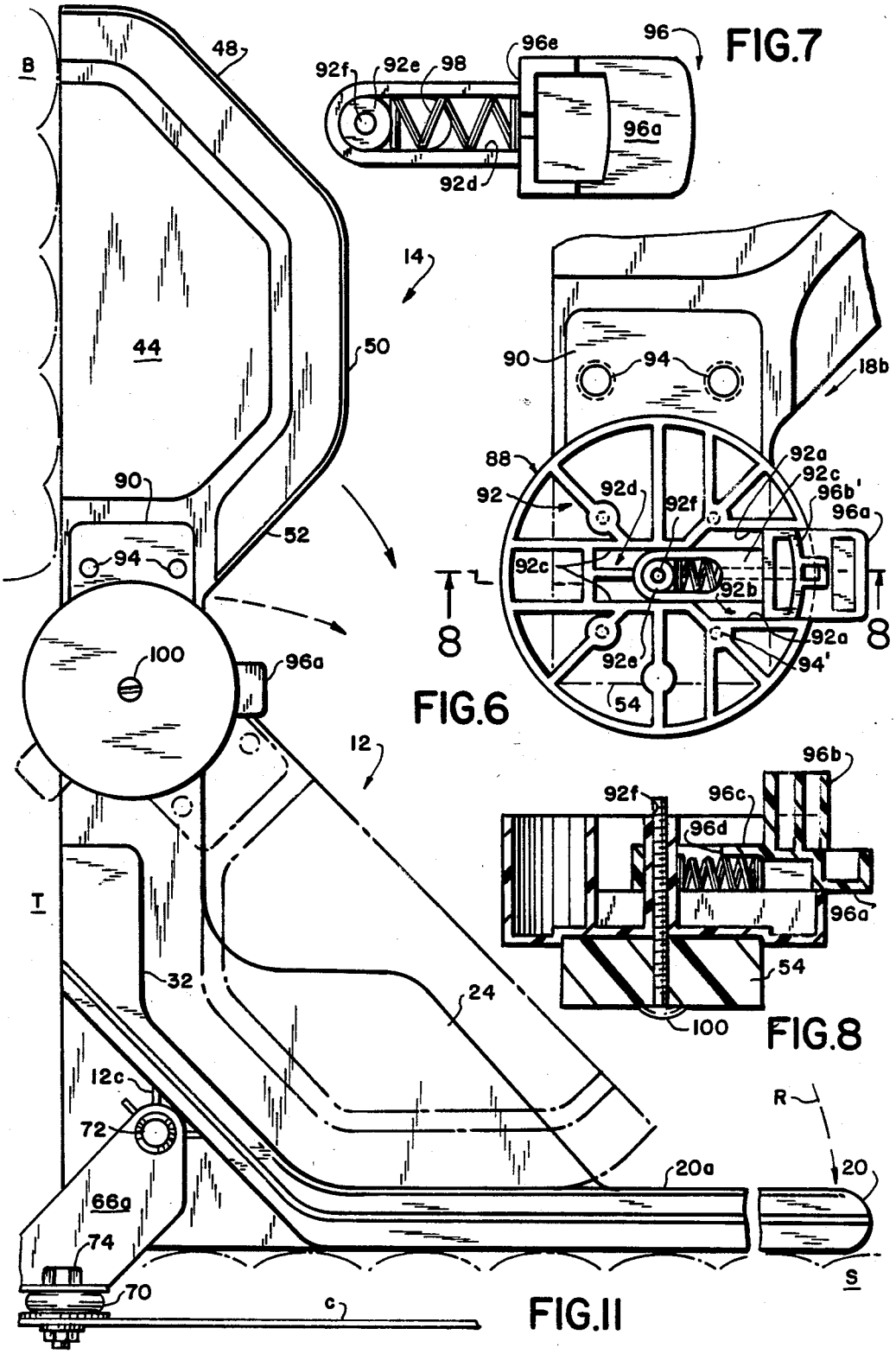
FIG. 6 is a side elevational view of the upper pivot lock member connected to or attached to the seat upper body or housing or back rest portion of the child seat, showing the push button in the unfolded condition of the child seat.
FIG. 7 is an enlarged side elevational view of the push button shown in FIGS. 4 and 6, showing the manner in which a compression spring is arranged to urge the button radially outwardly.
FIG. 8 is a cross section of the upper pivot lock member shown in FIG. 6, taken along line 8—8.
FIG. 11 is an enlarged side elevational view of the child seat shown in FIG. 1, showing the seat in solid outline in its unfolded condition and extended position, and also showing the seat in phantom outline in the folded condition thereby resulting in a smaller clearance radius for movement into a trunk or storage compartment.

Referring to FIG. 6, the upper pivot lock member 18b is similarly formed of a circular outer housing 88 which is in the nature of a cylindrical wall as shown. The housing 88 is open at the side as viewed in FIG. 6, and closed at the other end or side thereof. In the embodiment shown, a mounting plate or flange 90 is integrally formed with the housing 88 to permit attachment of the upper pivot lock member 18b to the mounting extensions 54 of the seat upper body or housing 14. The specific manner of attachment is not critical as long as a rigid connection is formed. As with the lower pivot lock member, the upper pivot lock member may also be integrally molded with the mounting extensions 54.

Formed within the circular housing 88 is a series of reinforcing ribs 92, including substantially spaced and parallel guide ribs 92a which define a button guide channel 92b; and spaced parallel guide ribs 92c which define an extension guide channel 92d. The reinforcing ribs 92 also form a center boss 92e which is molded to the housing 88 and defines a central hole 92f.

The hole mounting plate or flange 90 is provided with holes 94 which can be used for attachment to the mounting extensions 54 in any suitable or conventional manner.

Although the upper pivot lock member 18b is shown to be provided with an integrally formed mounting plate or flange 90, the reinforcing ribs 92 may be provided with enlarged internal bosses 94' positioned to be coextensive with the mounting extensions 54 which extend downwardly as suggested by the dashed outline in FIG. 6. In that event, screws or other fasteners may be used to attach the housing 88 directly to the seat upper body or housing 14 by extending through the internal bosses 94'.

The housings 76 and 88 are of the same diameter and, it will be appreciated, that they each form substantially one-half of a closed cylindrical container or housing when they are mated and concentrically aligned, and the upper pivot lock member 16b is attached to the lower pivot lock member by means of a screw 100 which forms an attachment element as well as a pivot for the upper pivot lock member and, therefore, for the seat upper body housing 14.

Referring to FIGS. 6–8, the push release button 96 is shown provided with an enlarged portion 96a which is dimensioned to be received in and freely slide within the button guide channel 92b of the upper pivot lock member and extend therethrough so as to be accessible to the user as shown. The button 96 is advantageously molded as a single or integral unitary construction, and is provided with a cam stop or lock 96b (FIGS. 6 and 8) which is dimensioned to be received within the holes or openings 82 and 84 (FIG. 4) and is provided with a radially inward circular limit surface 96*b*′ which engages the circular rib 78 to limit penetration into the holes 82, 84. Extending rearwardly from the enlarged portion 96*a* is a button extension 96*c* formed with a longitudinal slot 96*d* which extends beyond and receives the center boss 92*e* (FIGS. 6 and 7) as shown. A compression spring 98 is placed between the center boss 92*e* and an abutment or shoulder 96*e* of the button 96, the spring 98 being under compression to thereby urge the push release button 96 radially outwardly. Referring to FIG. 4, the radial length of the cam stop or lock 96*b* is approximately equal to the distance offset or radial spacing differential between the ends 78*b* and 80*b* so that when the cam stop or lock 96*b* registers with the hole 84 it is only partially received therein as shown due to engagement between the limit surface 96*b*′ and the rib 78.

The center and upper belt lock assemblies 38, 58 are advantageously used to maintain the child seat in the desired upright position and to prevent excessive movements of the child seat about the fixed pivot 64. These lock assemblies 38, 58 can be in the nature of conventional seat belts portions of which are fixed to the vehicle chassis and the mating portions of which are attached to the infant seat as shown in FIG. 1. The lock assemblies may be optional where the child seat, in the locked unfolded condition, is positioned to abut against the fixed seat and back seat portions of the adult seat to substantially fix the position of the child seat and prevent excessive rocking movements thereof.

Referring to FIG. 11, the operation of the seat will be described. In FIG. 11, the seat is shown in its position for use in solid outline. The lower seat portion 12 advantageously rests on the adult seat section S with the seat surface 20*a* generally facing upwardly. The back rest portion 14 extends upwardly so as to abut against the adult back rest section B and to arrange the lower back rest surface 21*a* and the upper back rest surface 42 in substantially a common plane. The cam stoplock 96*b* is received within the hole or opening 82 to positively lock the lower seat and the upper back rest portions 12, 14 as shown. When the child or infant seat is no longer needed, the push release button 96 is depressed radially inwardly against the action of the compression spring 98 sufficiently to remove the cam stop or lock 96*b* from the hole or opening 82 until the cam stop or lock 96*b* is placed on the cam surface 80*c*. In this condition, the upper back rest portion 14 can be rotated in a clockwise direction, as viewed in FIG. 10, assisted by the spring 98, and brought from its unfolded condition shown in solid outline to its folded condition shown in dashed outline. This involves a rotation of the back rest portion 14 approximately 135 degrees about the movable pivots or pivot screws 100. In the folded condition, the vertical edges or surfaces 50 abut against the mating surfaces 34 while the edges or surfaces 52 mate with the vertical edges of surfaces 32. The inclined edges or surfaces 48 mate with and abut against the seat surface 20*a*. This mating of surfaces and edges assures optimum folding or compactness of the resulting infant seat in the folded condition. In FIG. 11, a dashed circular arc R designates the clearance radius of the infant seat in its folded condition. It will be appreciated that the radius of this arc R is approximately one-half of the overall height of the seat in relation to the fixed pivot points at the brackets 66 when the infant seat is unfolded.

Due to the arrangement of the cam slide 80, the cam stop or lock 96*b* projects the full radial distance beyond the free end 78*b* of the circular rib 78, although just barely extends beyond the advantageously rounded free end 80*b* of the cam slide 80. The free end 78*b* prevents the cam stop or lock 98*b* from advancing to a greater extend radially outwardly in relation to the free end 80*b*. It will be appreciated, therefore, that while penetration of the cam stop or lock 98*b* into the hole or opening 82 provides a very positive locking engagement to thereby assure a locked condition of the seat in its unfolded condition as shown in FIG. 10, the lower seat and upper back rest portions 12, 14 are just barely locked in the folded condition, thereby facilitating easy and rapid unfolding of the seat with a minimum of effort and without the need to depress the push release buttons 96. Once unlocked in the unfolded condition by the depression of the push release button 96, however, the movement of the upper back rest portion 14 to the folded condition is likewise facilitated due to the action of gravity and/or the weight of the upper back rest portion 14, and the increasing distance of the cam slide 80 from the center hub or pivot screw 100 as the cam stop or lock 96 moves from the free end 80*a* to the free end 80*b* due to the action of the biasing spring 98. It will be appreciated, therefore, that the child seat in the folded condition has a clearance radius about the fixed pivot, consisting of the axle 64, which is smaller than the seat in the unfolded condition. In this manner, the movement of the child seat in the folded condition to the retracted position into smaller storage compartments and generally areas of smaller dimensions is facilitated or made possible. This construction makes it feasible to use the infant seat disclosed in my prior U.S. Pat. No. 4,664,443 in smaller and more compact automobiles or other vehicles or such vehicles which have smaller clearances which might otherwise interfere with the pivoting rotation of the seat into the trunk or storage compartment.

While the invention is described with reference to specific embodiments thereof and with respect to the incorporation therein of certain combinations of features, it is to be understood that the invention may be embodied in other forms, many of which do not incorporate all of the features present in this specific embodiment of this invention which has been described. For example, the locking assemblies 16, 18 can be replaced with any other pivots and locking arrangements to selectively permit the locking of the lower seat and upper back rest portions to each other to form a substantially rigid child set in the unfolded condition, while permitting unlocking to reduce the size of the seat for clearance and storage purposes. For this reason, the invention is to be taken and limited only as defined by the claims that follow.

What is claimed is:

1. An adult to infant convertible seat for automobiles and other moving vehicles having a storage compartment behind the convertible seat comprising:

(a) a back rest section and a seat section, and a storage compartment behind said back rest section;

(b) a child seat pivotally mounted about fixed pivot means for movements between retracted and extended positions in relation to the storage compartment, said child seat including an upper back rest portion and a lower seat portion which are selectively connected and locked to each other in one of folded and unfolded conditions to move together in the folded condition as a single unit between said extended and retracted positions, said child seat being substantially retractable within said storage compartment when folded, and said child seat being substantially extendable exterior of said storage compartment when unfolded for receiving a child by positioning said movable back rest portion generally proximate to said back rest section and said lower seat portion generally proximate to said seat section;

(c) restraining means for restraining a child placed in said child seat in the extended position of said child seat;

(d) movable pivot means for pivotally connecting said back rest and seat portions for movements between said folded and unfolded conditions; and (e) locking means for locking said back rest and seat portions to each other in each of said folded and unfolded conditions, said child seat in said folded condition having a clearance radius about said fixed pivot means smaller than in said unfolded condition, whereby retracting of said child seat in said folded condition into smaller storage compartments and areas of smaller dimensions is facilitated or made possible.

2. An automobile convertible seat as defined in claim 1, wherein said upper back rest and lower seat portions of said child seat have lower and upper mounting extensions, respectively, proximate to said movable pivot means, said movable pivot means comprising movable pivots pivotally connecting associated lower and upper mounting extensions.

3. An automobile convertible seat as defined in claim 2, wherein said locking means comprises lower pivot lock members on said upper mounting extensions and upper pivot lock members on said lower mounting extensions, associated pivot lock members being concentrically aligned with said movable pivots for relative rotation about said movable pivots; and push button means for selectively locking and unlocking said lock members in predetermined relative positions about said movable pivots.

4. An automobile convertible seat as defined in claim 3, wherein said push button means comprises a push button and cam means for positively locking said push button in said unfolded condition and partially engaging said push button in said folded condition to facilitate unfolding of said child seat.

5. An automobile convertible seat as defined in claim 4, wherein said cam means comprises a cam on said push button and a cam surface defining first and second openings for receiving said cam in said unfolded and folded conditions, respectively, of said child seat, said first opening being arranged to more fully receive said cam than said second opening, biassing means for urging said cam radially outwardly on said cam surface and into said openings, whereby unlocking of said upper back rest and lower seat portions of said child seat requires depression of said push button to remove said cam from an opening and placing same on said cam surface.

6. An automobile convertible seat as defined in claim 5, wherein said first and second openings are displaced approximately 135 degrees from each other about said movable pivots, whereby said upper back rest and lower seat portions of said child seat are rotated relative to each other about said movable pivots approximately 135 degrees in moving between said unfolded and folded conditions.

7. An automobile convertible seat as defined in claim 3, wherein said lower pivot lock members are integrally formed with said upper mounting extensions.

8. An automobile convertible seat as defined in claim 3, wherein said upper pivot lock members are integrally formed with said lower mounting extensions.

9. An automobile convertible seat as defined in claim 1, further comprising shock absorbing means for substantially reducing shocks to said child seat which would normally be transmitted thereto from movements of the automobile or moving vehicle.

10. An automobile convertible seat as defined in claim 9, wherein said shock absorbing means comprises resilient material interposed between the vehicle and said fixed pivot means.

11. An automobile convertible seat as defined in claim 1, further comprising position maintaining means for selectively maintaining said child seat in said extended position and unfolded condition.

* * * * *